United States Patent [19]

Willis

[11] 4,168,755

[45] Sep. 25, 1979

[54] NUTATING DRILL BIT

[75] Inventor: Clyde A. Willis, Wichita Falls, Tex.

[73] Assignee: Walker-Neer Manufacturing Co., Wichita Falls, Tex.

[21] Appl. No.: 822,710

[22] Filed: Aug. 8, 1977

[51] Int. Cl.[2] ..... E21B 9/08

[52] U.S. Cl. ..... 175/343; 175/215; 175/60; 175/372; 175/403

[58] Field of Search ..... 175/60, 215, 343, 348, 175/378, 372, 333, 332, 410, 92, 215, 325, 100

[56] References Cited

U.S. PATENT DOCUMENTS

| | | | |
|---|---|---|---|
| 1,087,632 | 2/1914 | Benjamin | 175/5 X |
| 1,945,240 | 1/1934 | Tupica | 175/378 X |
| 2,013,838 | 9/1935 | Pickin | 175/333 |
| 2,025,261 | 12/1935 | Zublin | 175/378 X |
| 2,362,860 | 11/1944 | Rossman | 175/348 |
| 2,598,518 | 5/1952 | Dufilho | 175/348 |
| 3,338,322 | 8/1967 | Henderson | 175/60 X |
| 3,429,390 | 2/1969 | Bennett | 175/343 |
| 3,616,868 | 1/1970 | Bassinger | 175/92 |
| 3,941,196 | 3/1976 | Curington et al. | 175/100 |
| 4,057,118 | 11/1977 | Ford | 175/215 |

FOREIGN PATENT DOCUMENTS

| | | | |
|---|---|---|---|
| 2155925 | 2/1973 | Fed. Rep. of Germany | 175/348 |

*Primary Examiner*—Ernest R. Purser
*Assistant Examiner*—Richard E. Favreau
*Attorney, Agent, or Firm*—Hume, Clement, Brinks, Willian & Olds, Ltd.

[57] ABSTRACT

A nutating earth drilling bit which is adapted for use in drilling systems in which the drilling fluid and cuttings are transported from bit to surface through the interior of the drill string. The nutating bit is provided with a toroidal cutting member and a longitudinally extending annular shank, both of which have longitudinally extending passageways aligned with one another and in flow communication with the central return conduit of the drill string. The cutting member of one embodiment has a segmented cutting web at its lower end which divides the central passageway into three separate fluid return channels. Another embodiment drills an annular hole face around an uncut earth core, the core being permitted to rise into the shank member where it is broken into short segments by a core breaker.

18 Claims, 10 Drawing Figures

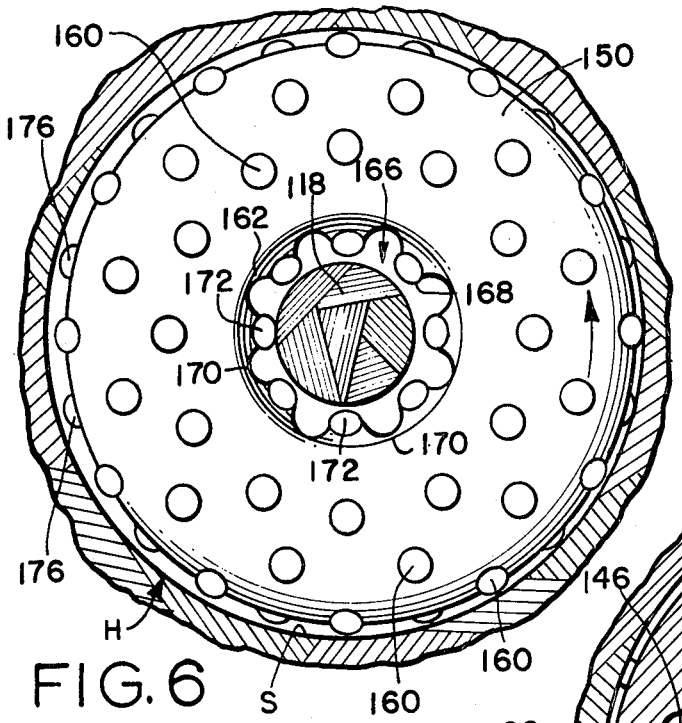
FIG. 6
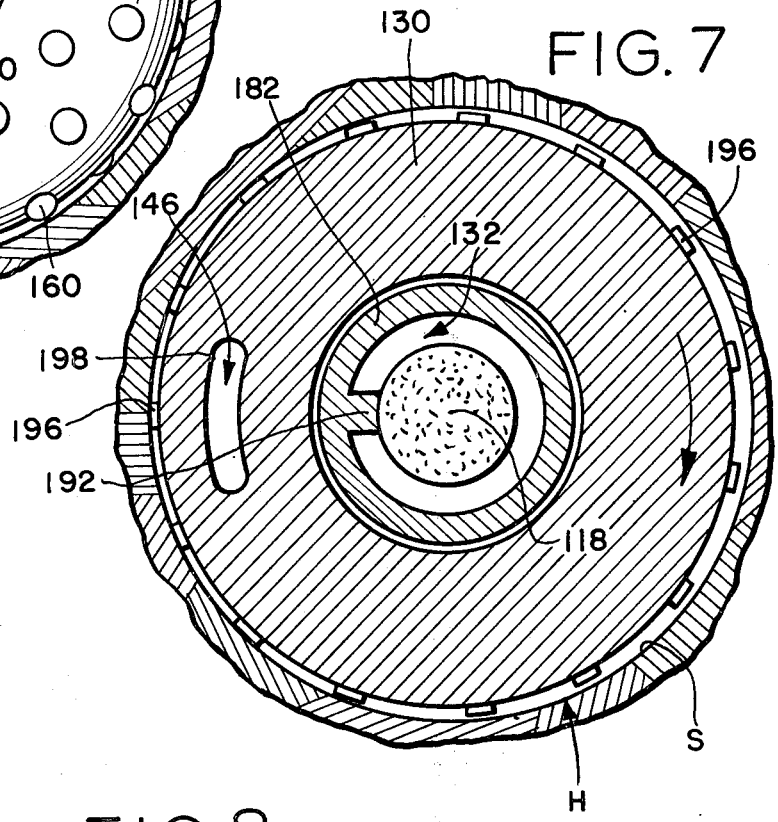
FIG. 7
FIG. 8
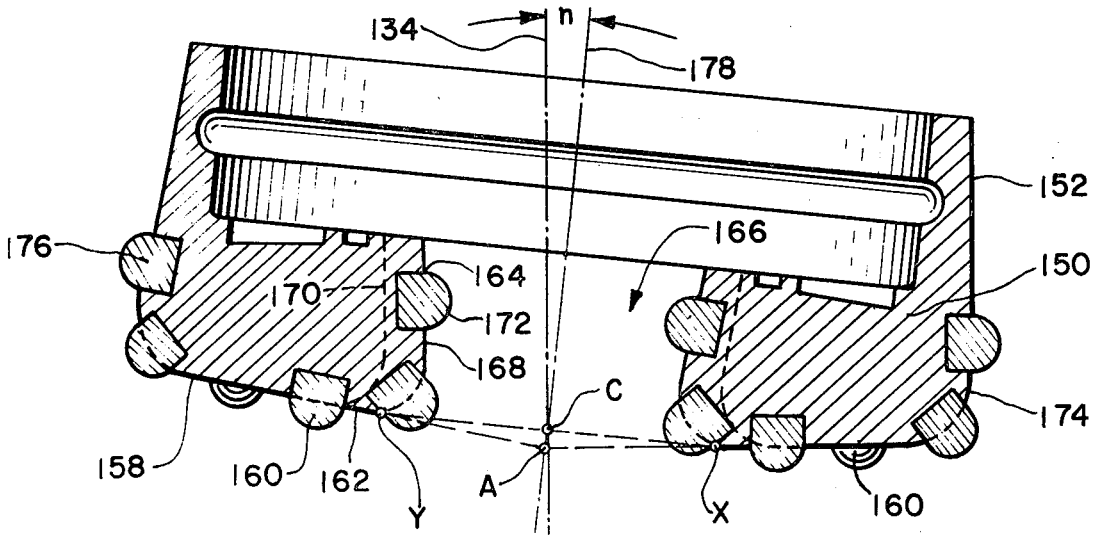

FIG. 9
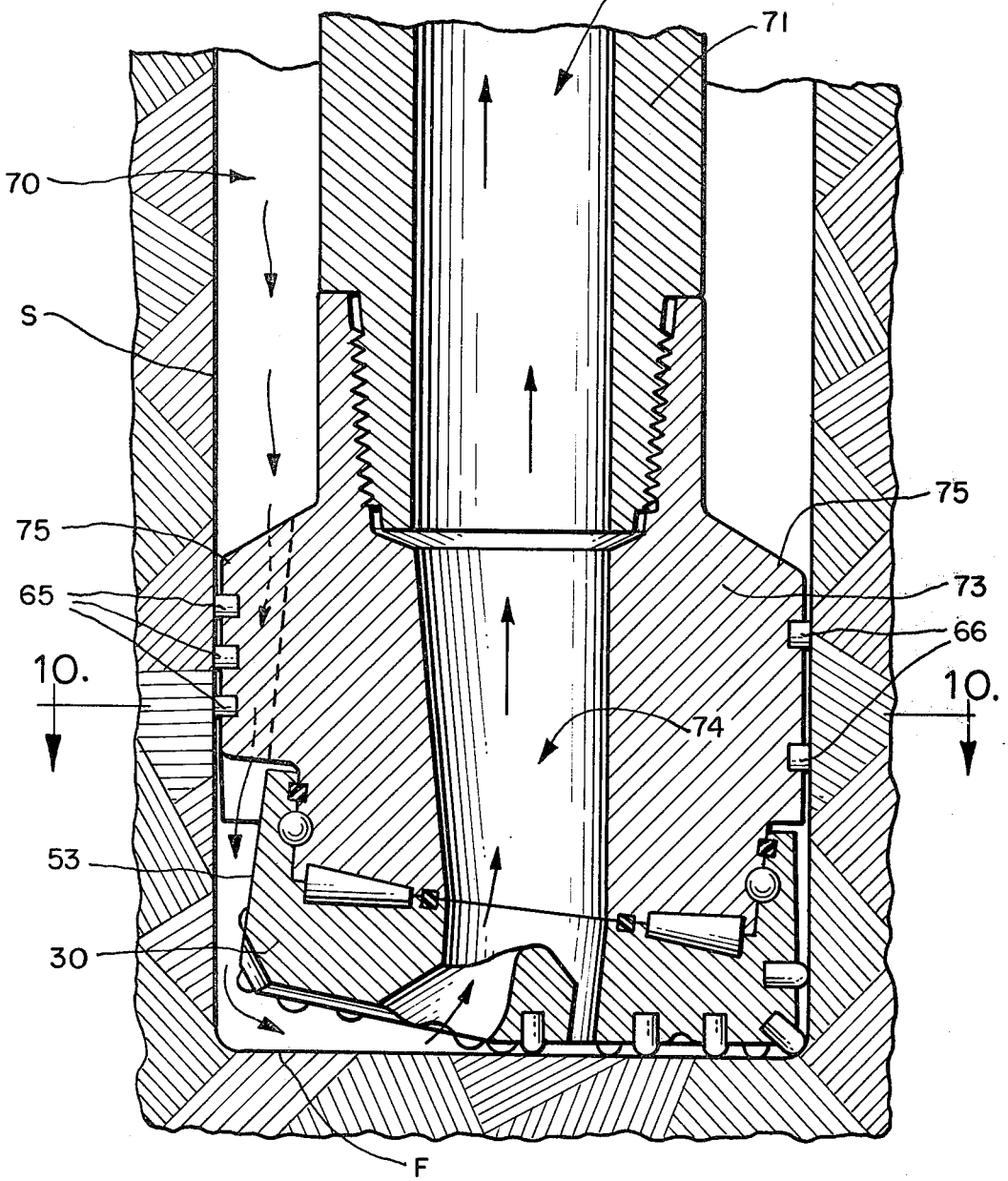
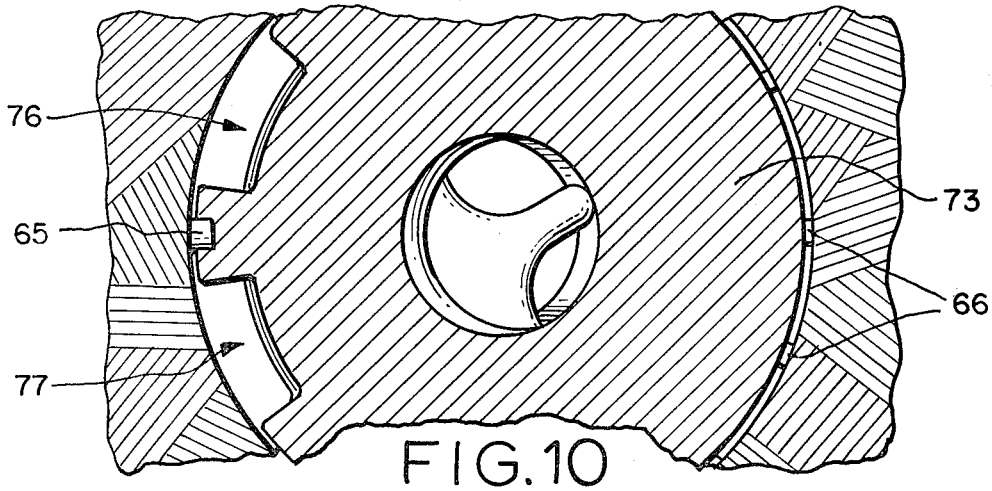
FIG. 10

NUTATING DRILL BIT

BACKGROUND OF THE INVENTION

This invention relates to an improved nutating earth drilling bit for use in drilling systems in which the drilling fluid and cuttings are lifted to the surface within the drill string, rather than in the annular space between the drill string and the hole wall (the hole annulus) and which is primarily intended for the drilling of hard formations.

In single tube drilling systems utilizing conventional circulation, a drilling fluid (e.g., mud or water) is pumped through the drill string to the bit, and returns to the surface in the hole annulus. Nutating drill bits for conventional circulation drilling systems have been known for a number of years. See, for example, Campbell U.S. Pat. No. 1,954,166, Thaheld U.S. Pat. No. 2,020,625, Zublin U.S. Pat. Nos. 2,025,260 and 2,275,832, and Bennett U.S. Pat. No. 3,429,390. In such drilling bits, the axis of rotation of the freely rotating cutting member is formed at a relatively small angle with respect to the axis of rotation of the drill string and the hole being produced by the bit. As a result, the cutting member slowly retrogresses with respect to the drill string's rotation and undergoes nutational action.

Dual concentric drill pipe is employed in a number of drilling systems in which the drilling fluid and cuttings are transported to the surface inside the drill string rather than in the hole annulus. This type of drill pipe, which is described in Henderson U.S. Pat. No. 3,208,539, has an inner tube concentrically disposed within an outer pipe, thus defining a continuous annular flow passage between the two tubular members (the pipe annulus or annular conduit) and a continuous cylindrical flow passage through the inner tube (the central conduit). In enclosed circulation drill systems, the annular conduit delivers drilling fluid (e.g., mud, water, etc.) from the surface to the bit and the central conduit carries the drilling fluid and entrained cuttings from the bit to the surface.

SUMMARY OF THE INVENTION

The invention relates to a nutating earth drilling bit for drilling systems, such as dual concentric drill pipe systems, in which the drilling fluid and cuttings are carried to the surface through the interior of the drill string. The nutating bit of the invention is primarily intended for hard formations. This nutating drill bit is provided with a generally toroidal shaped cutting member and a longitudinally extending annular shank member, both of which are provided with aligned, longitudinally extending central passageways in flow communication with the return conduit of the drill string. These passageways provide the flow channels for the passage of drilling fluid and entrained cuttings from bit to surface.

The toroidal cutting member is provided with an annular drill face carrying a plurality of earth drilling inserts. The cutting member is rotatably mounted on the lower end of the shank member, with the rotational axis of the cutting member forming a relatively small angle with respect to the longitudinal axis of rotation of the shank member. This angularity causes the cutting member to slowly retrogress and nutate as the shank member and the drill string to which it is attached rotate. Because of the nutating action of the cutting member, only a small radial segment of the drill face is engaged with the formation at any one time. The remaining radial segments of the drill face are raised away or disengaged from the formation. Since the cutting member is always rotating, any fixed point on the drill face moves through a pattern of descent toward the hole face, drilling engagement, ascent, descent again, and then drilling engagement at a different point along the hole face.

The portion of the shank member situated above the segment of the toroidal cutting member furthest from the hole face is provided with means, advantageously one or more drilling fluid delivery channels, which direct the flow of drilling fluid toward the segment of the drill face furthest from the hole face. This drilling fluid direction means produces a jet-like action across the disengaged segment of the drill face and the corresponding segment of the hole face which results in a highly efficient cleaning of the drill face and the hole bottom. The shank member is provided with a wear resistant bearing along one longitudinal section of its outer periphery, or with an equivalent means, to help force the engaged segment of the cutting member into better engagement with the formation and to help prevent wear to the shank member proper. Advantageously, the lower circumferential portion of the outer periphery of the cutting member is provided with a plurality of earth drilling inserts similar to those provided on the drill face.

In one preferred embodiment of the invention, the toroidal cutting member is provided with a generally annular drill face and with a segmented cutting web formed in the lower end of the cutting member's central passageway. This cutting web divides the bottom portion of the central passageway into a number of relatively large, separate, fluid return flow channels connecting the hole bottom and drill face with the central passageway and return conduit. In this embodiment, both the drill face and the cutting web are provided with a number of earth drilling inserts, preferably sintered carbide button inserts, to drill the earth formation. Advantageously, the cutting web and the inserts provided thereon are arranged to cut the center of the hole without tracking. This may advantageously be accomplished by offsetting the center of the web with respect to the longitudinal axis of the bit and arranging the drilling inserts on the web segments so that no two inserts are the same distance from the bit's longitudinal axis. Advantageously, the drill face itself is formed into a number of raised ribs or islands on which the drilling inserts are located and generally radially aligned bailing channels which separate the ribs. In addition, the outer periphery of the drill face is provided with an alternating series of ribs and drilling fluid flutes, and the inner periphery of the drill face is provided with bailing passages sloped upwardly toward the fluid return flow channels and the central passageway.

In another preferred embodiment of the invention, the drill bit is adapted to drill an annular bore hole about an uncut earth core. This may advantageously by accomplished by providing the inner edge of the annular drilling face and the inner periphery of the toroidal cutting member with a series of alternating ridges and depressions. The ridges are provided with earth drilling inserts which help cut the inner edge of the annular bore hole and which also cut away a small portion of the core above its base to give the core its ultimate diameter. The depressions form passageways for the upward flow of drilling fluid and cuttings from the bore hole. In addition, a core breaker means is advantageously provided to break the extending earth core into short sections so that the core may be lifted to the surface through the lifting action of the drilling fluid.

The nutating drilling bits of the invention primarily drill the formation through the application of pressure along the very narrow segment of the drill face which is engaged with the formation at any given time. Pressure also may be applied to the formation by inserts on the narrow segment of the cutting member's outer perphery above the engaged segment of the drilling face. Neglibible abrasive action occurs with the segmented web type nutating bits of the present invention as compared to the abrasive action produced with rolling type cutters such as tri-cone bits.

A principal advantage of the nutating bits of the invention is improved drill face and bottom hole cleaning which results in power savings and improved drilling efficiency. Because drilling fluid is delivered along the disengaged, raised portion of the cutting member and is removed from the hole bottom through the central flow passages in the cutting member, the drilling fluid is concentrated over the drilling surfaces and the portion of the hole bottom which are easiest to clean. This highly efficient cleaning is significantly aided by the drill face design, and by the relatively large return flow channels in the cutting member which permit efficient removal of cuttings. Moreover, because all of the drilling fluid may be delivered to the drill face and hole bottom with a jet-like action and removed together with the cuttings through relatively large return flow channels, a sweeping pick-up action is produced which cleans the drill face and removes cuttings with a minimum of cutting recrushing.

Another significant advantage of the invention is the availability of nutating drilling action for dual concentric drill pipe drilling system, something which has not been available heretofore. In addition, continuous accurate, real time mineralology may be obtained for hard formations at the same time that the hole is being rapidly and efficiently drilled, since relatively unleached chips from the hole bottom are quickly brought to the surface in essentially the same sequence in which they are drilled. Moreover, drilling efficiency is also improved due to the minimization of abrasive drilling action encountered with the drill bits of the invention. This reduced abrasion improves cutter life, reduces power consumption and helps maintain hole gauge.

Additional features and advantages of the present invention will become apparent upon consideration of the following Description of the Preferred Embodiments and from the drawings, to which reference is now made.

BRIEF DESCRIPTION OF THE DRAWINGS

FIG. 6 is a bottom, plan view of the cutting member of the drill bit illustrated in FIG. 5;

FIG. 7 is a horizontal, cross sectional view of the shank member of the drill bit taken along line 7—7 of FIG. 5;

FIG. 8 is an enlarged longitudinal, sectional view of the cutting member of FIG. 5 illustrating certain dimensional features of the cutter member;

FIG. 9 is a longitudinal, sectional view of another embodiment of a nutating bit constructed in accordance with the invention; and FIG. 10 is a horizontal, cross sectional view taken along line 9—9 in FIG. 9.

DESCRIPTION OF THE PREFERRED EMBODIMENTS

Figure 1:
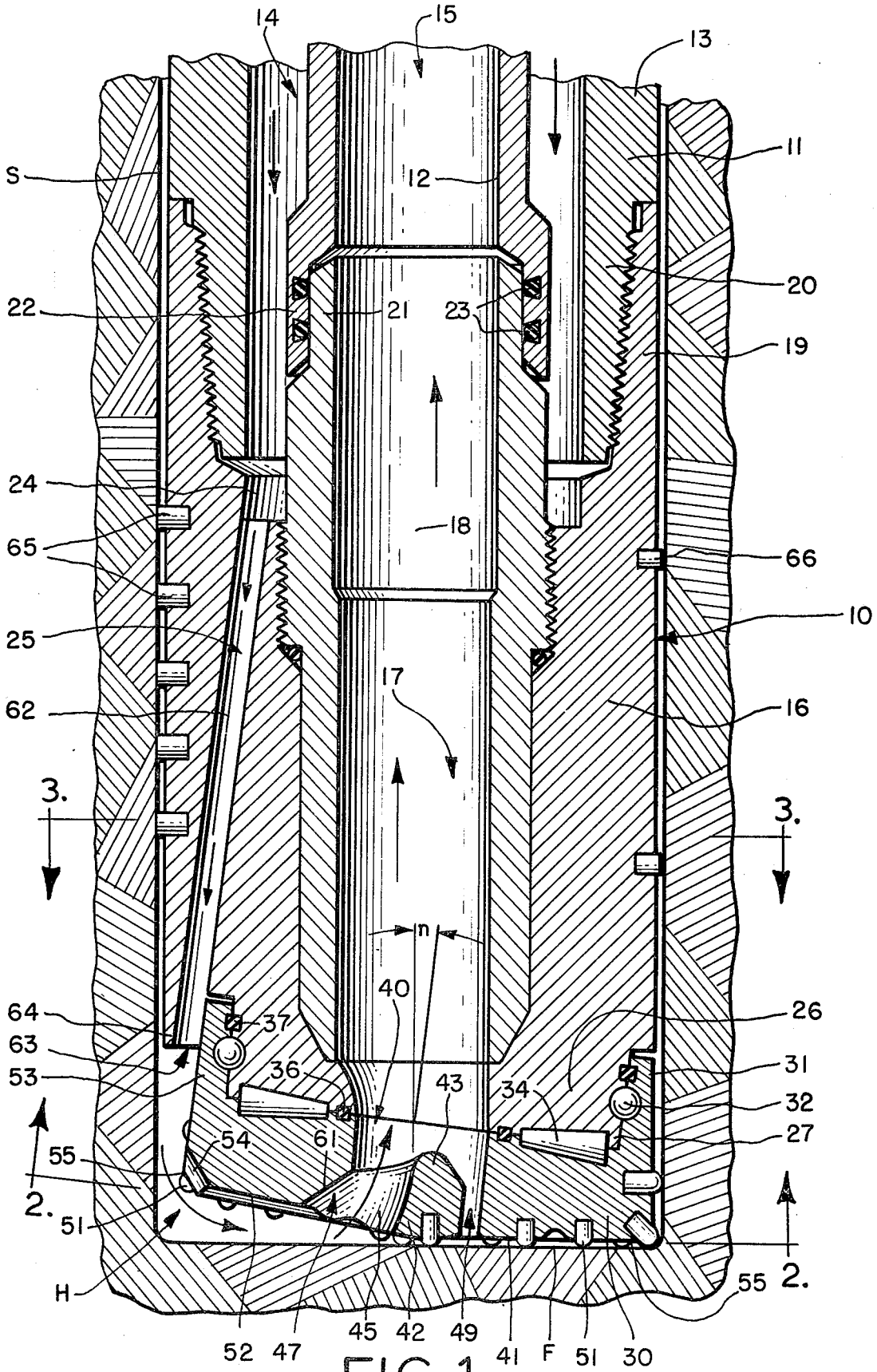
FIG. 1 is a longitudinal, sectional view of a preferred embodiment of a nutating earth drilling bit constructed in accordance with the invention, with the view of the cutting member taken along line 1—1 in FIG. 2.
Figure 2:
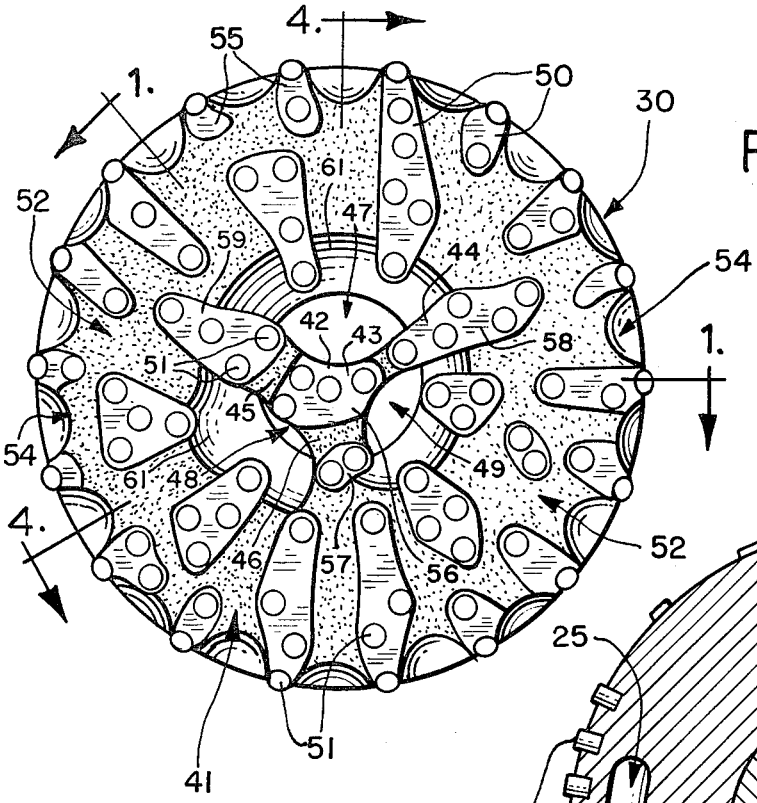
FIG. 2 is a bottom view of the cutting member of the drill bit illustrated in FIG. 1 taken along line 2—2 in FIG. 1.
Figure 3:
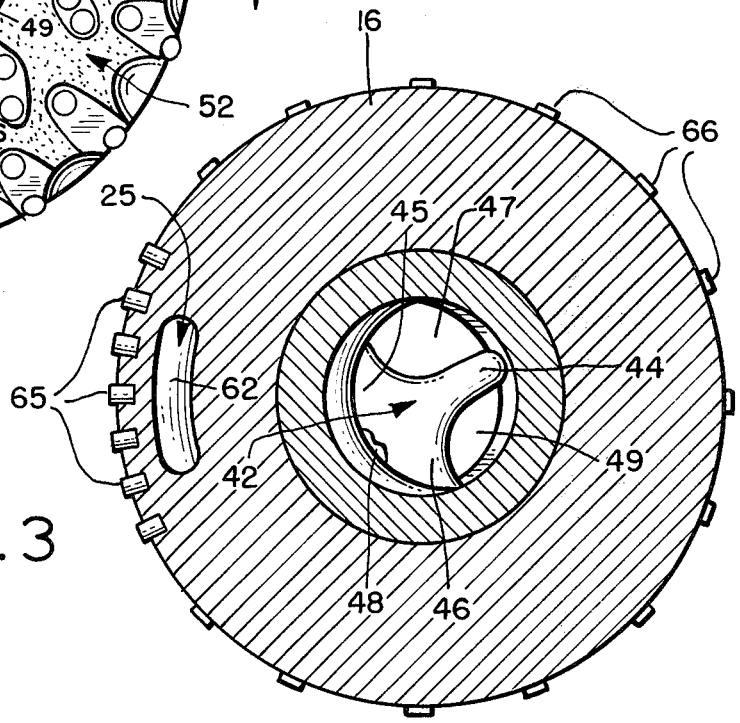
FIG. 3 is a horizontal, cross sectional view of the drill bit taken along line 3—3 in FIG. 1.

FIGS. 1 through 4 illustrate a preferred embodiment of the nutating earth drilling bit of the invention which is generally identified by reference numeral 10. Nutating bit 10 is illustrated in its normal operating environment, at the bottom of bore hole H which has a circular side wall S and a relatively flat hole face F.

The nutating bit 10 illustrated in FIGS. 1 through 4 is particularly adapted for drilling hard formations and for use with a string of dual concentric drill pipe which has inner and outer concentrically arranged tubular members forming continuous annular and central conduits from surface to bit. Normally, a series of drill collars are attached near the bottom of the drill string to provide the weight necessary for drill bit 10 to fracture the formation. These drill collars are provided with inner and outer concentrically arranged tubular members and with annular and central conduits which are contiguous with the conduits of the remainder of the drill pipe string. A bit sub 11 is normally provided between the lowest drill collar and drill bit 10. Bit sub 11 is provided with inner and outer concentrically arranged tubular members 12 and 13 which define annular conduit 14 and central conduit 15, which are contiguous with the annular and central conduits of the drill pipe string. In the enclosed circulation mode utilized with nutating bit 10, the drill string may also be provided with a bit packer to seal the annular space between the outer tubular member 13 and the hole wall S and thereby to prevent the drilling fluid from returning through the hole annulus. A preferred bit packer is the non-rotating bit packer disclosed in copending U.S. patent application, Ser. No. 618,811, filed Oct. 2, 1975, by George Alan Ford, for a Bit Packer for Dual Tube Drilling.

In the enclosed circulation drilling fluid mode utilized with nutating bit 10, annular conduit 14 is used to transport drilling fluid from the surface to nutating bit 10 to provide cooling and lubrication for the drilling process and to help clean the bit and the bottom of the bore hole. Central conduit 15 is used to return the drilling fluid to the surface along with entrained cuttings. Further details of the construction of the dual concentric drill pipe are disclosed in Henderson U.S. Pat. No. 3,209,539.

Shank 16 constitutes the upper member of nutating bit 10 and is located immediately below bit sub 11. Shank 16 is a generally annular member formed around a circular, longitudinally extending, central conduit 17 which is in flow communication with the lower end of the bit sub's central conduit 15. Central conduit 17 has the same centerline (and axis of rotation) 18 and approximately the same diameter as conduit 15, and is aligned with conduit 15 to form a continuous passageway for the flow of drilling fluid and cuttings to the surface.

The upper end of shank 16 is provided with an upwardly extending, threaded box portion 19 threadably connected to the threaded pin portion 20 of the outer tubular member 13 of bit sub 11. The upper end of shank 16 is also provided with an upwardly extending pin portion 21 which telescopically mates with the lower end 22 of inner tubular member 12 of bit sub 11. O-rings 23 are provided between pin portion 21 and lower end 22 to create a fluid tight seal between central conduit 15 and annular conduit 14. Box portion 19 and pin portion 21 of shank 16 are separated by the upper annular portion 24 of drilling fluid delivery channel 25 which is in flow communication with annular conduit 14.

Shank 16 is provided on its lower end with an annular, reduced pin 26, disposed about the lower end of central conduit 17. Pin 26 is mounted at an angle with respect to the common rotational axis 18 of shank 16 and the drill string. As illustrated in the drawings, this angle, angle n, the angle of nutation, is about 7°. However, angles of greater or lesser magnitude may be employed, although angles of nutation of 10° or less are generally preferred. Because of this arrangement, one section of pin 26, indicated by reference numeral 27, extends further into the bore hole than does the remainder of the pin.

Figure 4:
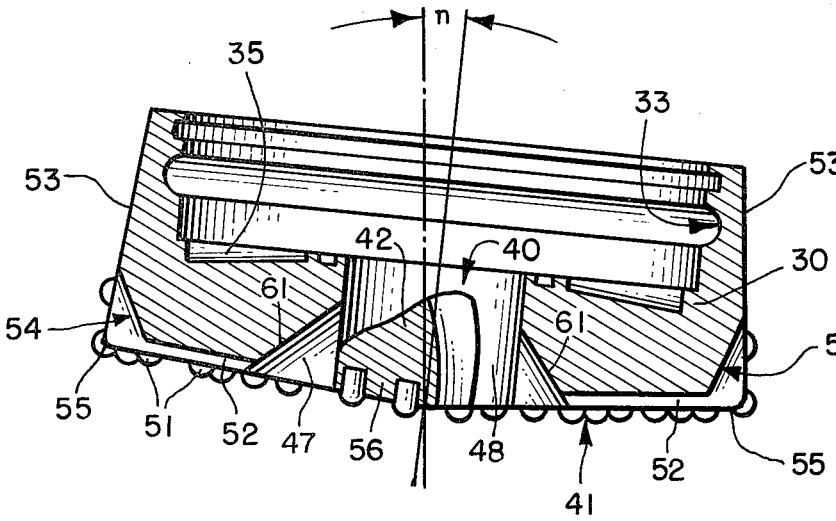
FIG. 4 is a longitudinal, sectional view of the cutting member of FIG. 1 taken along line 4—4 in FIG. 1.

The toroidal cutter 30, which constitutes the lower, drilling member of drill bit 10, is rotatably mounted on pin 26 by means of a sleeve 31 which extends from the upper end of cutter 30 and fits over and mates with pin 26. Cutter 30 is held on pin 26 by a series of retaining ball bearings 32 disposed in an annular cavity between hardened races formed at corresponding positions around the inner periphery of sleeve 31 and the outer periphery of pin 26, intermediate their longitudinal ends. The race on cutter 30 is shown in FIG. 4 by reference numeral 33. Retaining balls 32 are inserted into the cavity through a radial opening in sleeve 31, closed by a screw threaded pin once the balls are in place. Alternatively, needle bearings may be employed in place of retaining balls 32, with corresponding changes being made in the cooperating structure.

An annulus of large, tapered thrust bearings 34 is also provided between the lower end of pin 26 and the corresponding upper end of cutter 30. These bearings are disposed in an annular cavity formed between hardened races on both pin 26 and cutter 30. The race on cutter 30 is illustrated by numeral 35 in FIG. 4. Bearings 34 are lubricated, as are retaining balls 32, lubrication seals 36, 37 being provided to seal the lubricated surfaces from the bore hole environment. Other types of bearings which can withstand the high pressures encountered, such as graphite-silver bearings, may be used in place of the tapered thrust bearings illustrated in the drawings.

Because of the freely rotating, angular attachment of toroidal cutter 30 to shank 16, cutter 30 both nutates and slowly retrogresses as the drill string and shank 16 are rotated about their longitudinally disposed rotational axis 18. That is, as the drill string and the shank are rotated clockwise, cutter 30 rotates counterclockwise at a rate of about one revolution to each 20 to 40 revolutions of the drill string. Thus, if the drill string rotates at 200 revolutions per minute, cutter 30 rotates in the opposite direction at from about 5 to 10 revolutions per minute. During this retrogression, any fixed point on cutter 30 will be lowered into engagement with hole face F, will subsequently be raised away from the hole face, and will then be lowered back into engagement with the hole face, but at a different point. As illustrated in FIG. 1, the portion of cutter 30 immediately below the lowest extending radial portion 27 of pin 26 (illustrated at the right hand side of FIG. 1) will be engaged with hole face F. All other portions of cutter 30 will be raised away from the hole face, with the portion of cutter 30 diametrically opposite the engaged portion being the portion of cutter 30 furthest removed from the hole face. This furthest removed portion, which corresponds to the highest point of nutation of cutter 30, is illustrated at the left hand side of the cutter shown in FIG. 1.

The preferred toroidal cutting member 30 illustrated in FIGS. 1 through 4 is provided with a longitudinally extending central passageway 40 which is in flow communication with central conduit 17 of shank 16 and the central conduit 15 of the drill string. Cutter 30 also is provided with a slightly conical, generally annular drill face 41 and with a segmented cutting web 42 which drills the center of the bore hole. Cutting web 42, which consists of a central portion 43 and three radial segments 44, 45, 46, is formed in the lower end of central passageway 40 and divides the lower end of passageway 40 into three separate fluid return flow channels 47, 48, 49. Cutting web 42 and the body of cutting member 30 may be formed from the same piece of metal by the electric discharge machining of central passageway 40 and return channels 47, 48, 49. Alternatively, cutting web 42 may be bolted or fastened to cutting member 30 by any of the methods known in the art.

Drill face 41 is provided with a series of generally radially aligned raised ribs 50, which together have the same slightly conical surface as the drill face. Each of the ribs 50 is provided with one or more earth drilling inserts 51, preferably sintered tungsten carbide button inserts having rounded drilling surfaces. These preferred carbide button inserts, which are illustrated in the drawings, are particularly useful for pressure drilling of hard formations. These inserts may be replaced with other types of inserts, depending on the formation being drilled, and may even be replaced by long tooth inserts in the event the nutating bit is used to drill soft formations. Advantageously, ribs 50 and inserts 51 are arrayed so that the pattern of cutting of the formation does not repeat; i.e., they are arrayed so that a non-tracking, progressive patterned cutting of the formation takes place.

Cutting web 42 is provided with a central raised rib 56, rib 57 on web segment 46, and with ribs 58, 59 which are formed on both the cutting web 42 and drill face 41. The central rib 56 is separated from the outer ribs, 57, 58, 59 by bailing channels 60. Central rib 56 is not centered over the longitudinal axis 18 of the drill string, but is offset with respect thereto. Each of the ribs 56, 57, 58, 59 is provided with earth drilling inserts 51 of the same type provided on drill face 41. To eliminate tracking, no two of these inserts are located the same distance from longitudinal axis 18.

Drill face 41 also is provided with a series of generally radially aligned bailing channels 52 which separate ribs 50 from one another. The outer edge of drill face 41 and the lower edge of the outer periphery 53 of cutter 30 are provided with a series of drilling fluid flutes 54 separated from one another by a series of insert carrying ribs 55 located around the outer edge of the drill face.

Flutes 54 facilitate and direct the passage of drilling fluid to the bit face. The portions of the inner edge of drill face 41 which do not mate with cutting web 42 are cut away and are upwardly sloped to form bailing passages 61 which enlarge the fluid return channels 47, 48, 49 with which they mate.

Outer periphery 53, which includes the outer periphery of sleeve 31, is aligned so that it is parallel to bore hole side wall S when it is positioned above the engaged portion of drilling face 41. Because drilling face 41 of the preferred embodiment has slightly conical shape and cuts a flat hole face, outer periphery 53 is aligned perpendicular to the drilling face. The lower portion of outer periphery 53 is provided with a plurality of earth drilling inserts 51, similar to those provided on drilling face 41, which help fracture the formation and shape side wall S as the inserts engage the side wall during the nutational movement of cutter 30. The outer diameter of toroidal cutter 30 is slightly smaller than the outer diameter of shank 16, which, in turn, is somewhat smaller than the diameter of the bore hole. Preferably, the outer diameter of cutter 30 is equal to the outer diameter of the shank multiplied by the cosine of the angle of nutation, n.

While the toroidal cutters useful in the present invention have been described with reference to the preferred embodiment illustrated in the drawings, those skilled in the art will appreciate that the toroidal cutter may take other forms without departing from the spirit or the scope of the invention. For example, annular drill face 41 and the raised ribs 50 thereon may present a drilling surface which is generally flat (cutting an inwardly sloped annular hole), or which is curved or concave or even convex; the number of segments in the cutting web and the size and shape of the return channels may also be varied as may the relative positions, number and shape of the raised ribs and the bailing channels.

As noted above, shank 16 is provided with a drilling fluid delivery channel 25 which has an upper annular portion 24 in fluid communication with annular conduit 14. Below upper annular portion 24, drilling fluid channel 25 becomes a single arcuate slot 62 which delivers the drilling fluid with a jet-like action to the outer periphery 53 of the cutter 30 through opening 63. Downwardly depending skirt 64 may be provided on the portion of the shank 16 near opening 63 to aid in directing the drilling fluid over the cutter's drilling surfaces. As shown in FIG. 1, arcuate slot 62 and opening 63 are positioned so that they deliver drilling fluid to the portion of cutter 30 which is lifted away from the hole face, at the point diametrically opposite drilling engagement with the hole, since that is the portion of the cutter which is easiest to clean.

Because a portion of drilling inserts 51 on outer periphery 53 are engaged with side wall S, above the engaged portion of drilling face 41, cutter 30 has a tendency to move away from the side of the hole where the drilling engagement occurs. This movement tends to force the diametrically opposite portion of shank 16 into contact with the side wall S since shank 16 extends out further than cutter 30 at that point. Accordingly, shank 16 is provided with an abrasion resistant means to minimize wear, to absorb the side load imposed on the shank and to help force cutter 30 into its proper position for engagement with the formation. The preferred wear resistant means consists of an array of shank inserts 65 which project outwardly from shank 16 along the radial portion of the shank which is diametrically opposite the cutter's drilling engagement with the hole. Inserts 65 are advantageously carbide inserts provided with generally flat heads. A series of flat headed inserts 66 are provided along the other radial portions of the shank. Alternatively, a hard metal sleeve rotatably mounted on the shank proper, or any other equivalent means, may be used in place of shank inserts 65.

The drill bits of the invention provide a highly efficient system for cleaning the drill face and sweeping the hole bottom of cuttings. Because drilling fluid is delivered along the disengaged, raised portion of the cutting member and is removed through the relatively large return flow channels and the central conduit, the drilling fluid is concentrated over the drilling surfaces and the portion of the hole bottom which are easiest to clean. The drill face design cooperates in this cleaning action. The drilling fluid flutes around the periphery of the cutter help channel the fluid toward the drill face and the bailing channels thereon. The bailing channels direct the fluid into close proximity to all of the drilling inserts. The large openings for the return channels are of sufficient size so that the drilling fluid and entrained cuttings will quickly enter the return channels without swirling around the hole face. Moreover, the jet-like delivery of the drilling fluid to the hole face and the enclosed fluid return means promote a sweeping pick-up type of action across the drill face and hole face, which helps clean the drill face and remove cuttings with a minimum of cutting recrushing.

FIGS. 4 through 8 illustrate an embodiment of the invention in which the nutating bit 110 cuts an annular hole face F about an uncut earth core 118. The earth core is permitted to rise through the central passageway into the passageway in the shank member where it is broken into short segments by a core breaker.

A bit sub 120 is provided immediately above drill bit 110. Bit sub 120 is provided with inner and outer concentrically arranged tubular members 122 and 124 which define annular conduit 126 and inner conduit 128 which are contiguous with the annular and inner conduits of the drill collars and the drill pipe string. The diameter of inner conduit 128 is somewhat greater than that of earth core 118 so that segments of the core do not roll or become lodged as they are transported to the surface.

Shank 130 constitutes the upper member of nutating bit 110 and is located immediately below bit sub 120. Shank 130 is formed around central conduit 132 which is in flow communication with the lower end of inner conduit 128. Central conduit 132 has the same centerline (and axis of rotation) 134 and the same diameter as inner conduit 128 and is aligned with conduit 128 to form a continuous passageway for the flow of drilling fluid, cuttings, and core segments to the surface. Central conduit 132 is, or course, large enough to receive earth core 118 at its lower end.

The upper end of shank 130 is provided with an upwardly extending, threaded box portion 136 threadably connected to the threaded pin portion 138 of outer tubular member 124 of bit sub 120. The upper end of shank 130 is provided with an upwardly extending pin portion 140 which telescopically mates with the lower end 142 of inner tubular member 122 of bit sub 120. Shank 130 is provided on its lower end with an annular, reduced pin 148, disposed about the lower end of central conduit 134. Pin 148 is mounted at an angle (n) with respect to the common rotational axis 134 of shank 130 and the drill string. Preferably, this angle is about 7°.

A toroidal cutter 150 is rotatably mounted on pin 148 by means of a sleeve 152 which fits over and mates with pin 148. Because of the freely rotating, angular attachment of toroidal cutter 150 to shank 130, cutter 150 both nutates and slowly retrogresses as the drill string and shank 130 rotate about their longitudinally disposed rotational axis 136.

Figure 5:
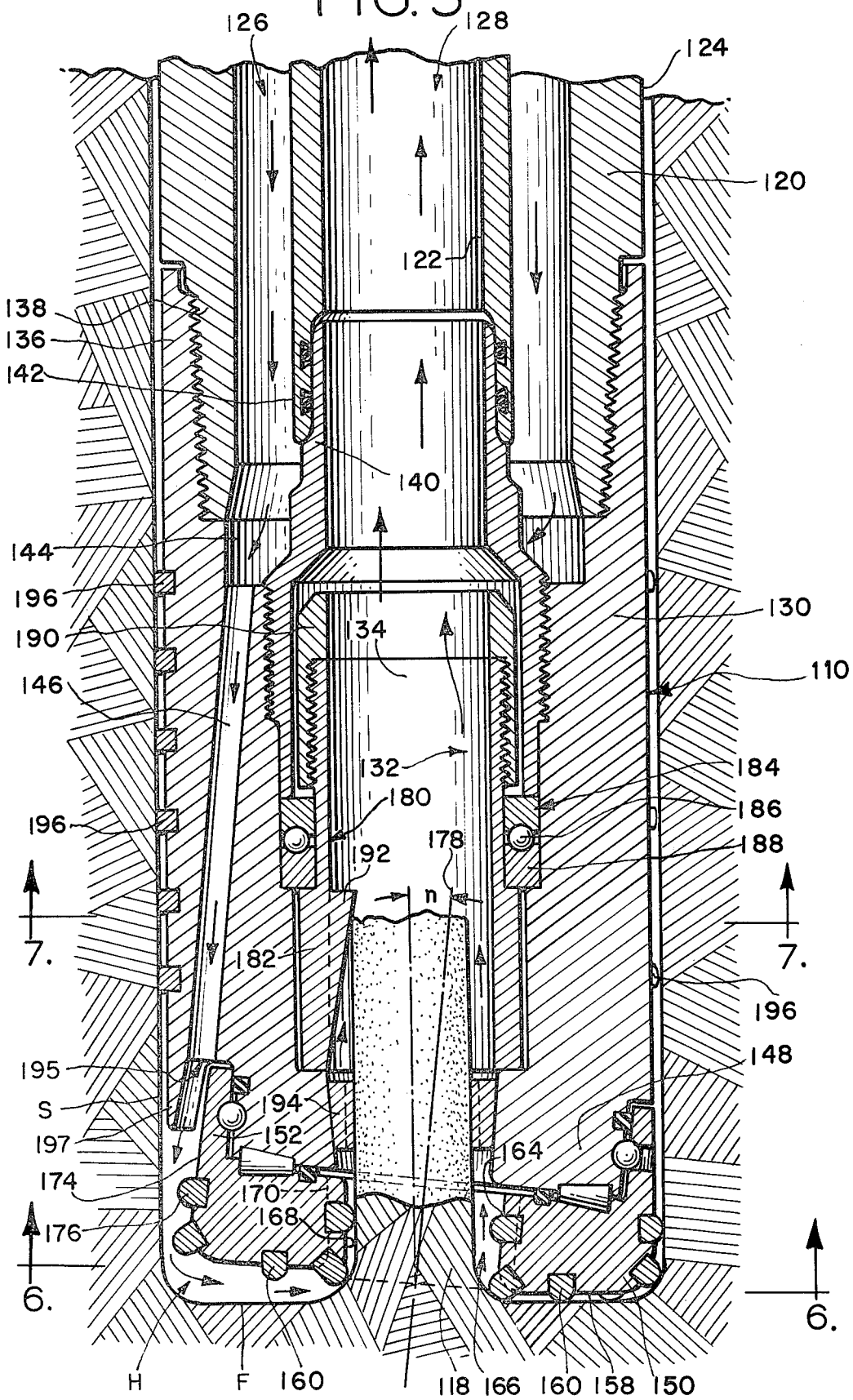
FIG. 5 is a longitudinal, sectional view of a preferred embodiment of a nutating, coring, earth drilling bit constructed in accordance with this invention.

The toroidal cutter 150 illustrated in FIGS. 5, 6 and 8 is of one-piece construction. It is provided with a slightly conical, generally annular drilling face 158 which cuts a relatively flat hole face F. Drilling face 158 is provided with a plurality of earth drilling inserts 160, preferably sintered tungsten carbide button inserts, having rounded drilling surfaces which are arrayed that the pattern of cutting does not repeat; i.e., they are arrayed so that a non-tracking, progressive, patterned cutting of the formation takes place.

Both the inner edge 162 of drilling face 158 and the inner periphery 164 of toroidal cutter 150, which extends from inner edge 162 and defines the center core passageway 166 in cutter 152, have a sinuous configuration which comprises a series of alternating ridges 168 and depressions 170 (only some of which are identified by reference numerals). Ridges 168 are designed so that they are aligned parallel to the axis of rotation 134 of shank 130 when they reach a position diametrically opposite from the portion of cutter 150 engaged with hole face F. Ridges 168 are provided with earth drilling inserts 172 similar to those used on drilling face 162. Inserts 172 help cut the inner edge of drill face F and help cut and shape core 118 to its ultimate diameter. Depressions 170 are provided between ridges 168 as passageways for the upward flow of drilling fluid and entrained cuttings from the bore hole.

The outer periphery 174 of cutter 150, which includes the outer periphery of sleeve 152, is aligned so that it is parallel to bore hole side wall S when it is positioned above the engaged portion of drilling face 158. Because drilling face 158 of the preferred embodiment has a slightly conical shape and cuts a flat annular hole face, outer periphery 174 is aligned perpendicular to the drill face. The lower portion of outer periphery 174 is provided with a plurality of earth drilling inserts 176, similar to those provided on drilling face 158. Inserts 176 help fracture the formation and shape side wall S as the inserts engage the side wall during the nutational movement of cutter 150.

The outer diameter of toroidal cutter 150 is slightly smaller than the outer diameter of shank 130, which, in turn, is somewhat smaller than the diameter of bore hole 112. Preferably, the outer diameter of cutter 150 is equal to the outer diameter of shank 130 times the cosine of the angle of nutation, n. Moreover, care must be taken in designing cutter 150 so that the point on the outer periphery diametrically opposite the engaged portion of cutter 150 does not contact the side wall of the hole, and so that ridges 168 do not have to cut away any substantial portion of core 118. This may most advantageously be accomplished by keeping the distance between point C (the point of intersection between the cutter axis of rotation 178 and the shank axis of rotation 134; see FIG. 8) and all of the most inwardly extending points on inner edge 162 (such points X and Y on ridges 168) equal; and also by keeping the distance between point A (the imaginary geometric apex of cutter 150) and all of the most inwardly extending points on inner edge 162 (such as X and Y) equal. Deviations from this dimensional arrangement will either result in contact between outer periphery 174 and side wall S opposite the point of intended engagement or in too much contact between ridges 168 and core 118. Significant deviations will result in too much abrasive engagement with the formation and will reduce the effectiveness of the bit.

Shank 130 is provided with a non-rotating core breaker 180 surrounding central conduit 132 to break core 118 into short segments which are carried to the surface by the drilling fluid. Core breaker 180 is provided with a core breaking member 182 mounted on bearing means 184 which includes a series of ball bearings 186, bearing race member 188, and bearing cap 190. Core breaker 180 is termed a non-rotating core breaker because bearing means 184 allows breaker 180 to remain stationary while the shank is rotating. Core breaking member 182 is provided with a wedge shaped segment 192 which extends into central conduit 132 so that a lateral force is imparted to the upper portion of core 118 as shank 130 descends around it. Once a sufficient lateral force has been applied to core 118, a segment breaks off which becomes entrained by the drilling fluid and is carried to the surface. Normally, this break occurs near the bottom of core breaking member 180, so that the core segment is typically about two to three times as long as its diameter. Shank 130 is provided with core catcher 194, which surrounds central conduit 132 below core breaker 180, to keep core segments from falling back into the bore hole when bit 110 is lifted off the hole bottom.

Because a portion of drilling inserts 176 on outer periphery 174 are engaged with side wall S above the engaged portion of drilling face 158, cutter 152 has a tendency to move away from the side of the hole where the drilling engagement occurs. This movement tends to force the diametrically opposite portion of shank 130 into contact with side wall S since shank 130 extends out further than cutter 150 at that point. Accordingly, shank 130 is provided with a wear resistant means consisting of a series of shank inserts 196 which project outwardly around the periphery of shank 130. Preferably, inserts 196 are provided along almost the entire longitudinal extent of the shank's periphery. Inserts 196 are advantageously carbide bits provided with generally flat heads.

Shank 130 is also provided with a drilling fluid channel 146 which has an upper annular portion 144 in fluid communication with annular conduit 126. Below upper annular portion 144, drilling fluid channel 146 becomes an arcuate slot 198 which delivers the drilling fluid with a jet-like action to the outer periphery 174 of cutter 150 through opening 195. Downwardly depending skirt 197 may be provided on the portion of shank 130 near opening 195 to aid in directing the drilling fluid over the cutter's drilling surfaces. As shown in FIG. 5, arcuate slot 198 and opening 195 are advantageously positioned so that they deliver the drilling fluid to the portion of cutter 150 which is diametrically opposite cutter engagement, since that is the portion of the cutter which is furthest from hole face F. If drilling fluid is delivered at this point, cutter and bottom hole cleaning are greatly facilitated. Since a substantial gap exists at this point between cutter 50 and the hole bottom, the drilling fluid has easy access to an entire exposed radial segment of the drilling surfaces and also has a opportunity to sweep over a portion of the hole bottom without interference from the cutter. Bottom hole cleaning is also facilitated by the presence of central passageway 166 and inner conduit 128 which permit the drilling fluid and its entrained cuttings to be quickly and efficiently removed from the hole, thus minimizing the amount of recrushing which occurs before the cuttings are removed from the drilling surfaces and the hole bottom.

The coring nutating bit provides an improved drilling efficiency by not cutting the center of the hole. Because the core is not drilled, the available pressure can be concentrated over a narrower area and fracture loads can be increased by a factor of about 1.5 to 3, depending on the core size.

The nutating bit of this invention may be adapted for use with reverse air lift drilling systems. In reverse air lift systems, a heavy drilling fluid such as mud or water (or natural water from a water bearing formation) is pumped or allowed to pass down the hole through the hole annulus to the bit. At the same time, compressed air or inert gas is pumped down the pipe annulus and is typically introduced into the inner tube at one or more points above the bit shank. Thus gas lightened, the slurry of cuttings and drilling fluid pass upward to the surface through the central conduit.

FIGS. 9 and 10 illustrate the use of the toroidal cutting member disclosed in FIGS. 1 through 4 with a shank member adapted for reverse air lift drilling. In this embodiment, compressed air is pumped down the pipe annulus and is injected into the central conduit, at one or more injection subs located above the bit, to assist in lifting the cuttings and fluid upward. Such an injection sub is illustrated in U.S. Pat. No. 3,978,923, issued Sept. 7, 1976 to George Alan Ford. At the same time, the drilling fluid 70 is pumped or allowed to pass down the hole annulus to the area near the bit.

Thus, bit sub 71 is a single conduit tubular element having a central conduit 72 in flow communication with the central conduit of the dual concentric drill pipe string located above the lowest injection sub. Bit sub 71 and the drill string above it have an outer diameter significantly smaller than the hole diameter so that the drilling fluid 70 may pass down the hole through the hole annulus. Bit sub 71 is threadably connected to bit shank 73 and shank 73 provided with an axially disposed conduit 74 in flow communication with central conduit 72. Shank 73 is provided with an enlarged hard metal skirt 75 whose diameter is just slightly smaller than the diameter of the bore hole. Skirt 75 is provided with two longitudinally disposed drilling fluid delivery passages 76, 77 which channel the drilling fluid to the outer periphery 53 of cutter 30, immediately adjacent that portion of the periphery which is furthest away from the hole face. The delivery of substantial quantities of drilling fluid to other portions of the cutter's periphery is effectively precluded by skirt 75. Because of the suction created in the central conduit by the injection of compessed air, the drilling fluid crosses the uplifted section of the drill face with such a velocity that is, in effect, tends to produce the jet-like action referred to above.

The embodiments described herein are intended to be exemplary of the types of nutating earth drilling bits which fall within the scope of the invention. However, it is expected that on skilled in the art would be able to make modifications and variations of the preferred embodiments without departing from either the spirit or the scope of the invention as it is defined in the following claims.

I claim:

1. A nutating earth drilling bit for use in a drilling system in which the drilling fluid and cuttings are carried to the surface through the drill string, comprising:

a toroidal shaped cutting member formed around a longitudinally extending central passageway, the cutting member having a generally ring shaped drill face carrying a plurality of earth drilling inserts;

a shank member having a longitudinally extending central passageway positioned over and in flow communication with the central passageway of the cutting member; and means for rotatably mounting the cutting member on the lower end of the shank member, with the longitudinal axis of the cutting member formed at an angle with respect to the longitudinal axis of the shank member; and wherein the portion of the cutting member forming the central passageway is sinuous and includes a series of alternating ridges and depressions, the ridges carrying earth drilling inserts, the depressions providing channels for the upward passage of drilling fluid and cuttings.

2. A nutating earth drilling bit for use in a drilling system in which the drilling fluid and cuttings are carried to the surface through the drill string, comprising:

a toroidal shaped cutting member formed around a longitudinally extending central passageway, the cutting member having a generally ring shaped drill face carrying a plurality of earth drilling inserts and a bridge element formed over the lower end of the central passageway, the bridge element carrying earth drilling inserts, and the bridge element and the cutting member forming a plurality of fluid return flow channels connecting the drill face with the central passageway;

a shank member having a longitudinally extending central passageway positioned over the central passageway of the cutting member; and means for rotatably mounting the cutting member on the lower end of the shank member, with the longitudinal axis of the cutting member formed at a small angle with respect to the longitudinal axis of the shank member.

3. The earth drilling bit of claim 2, wherein the bridge element is offset with respect to the longitudinal axis of the bit.

4. The earth drilling bit of claim 2, wherein the bridge element is offset with respect to the longitudinal axis of the bit and the bridge element includes three radially extending members separated from one another by the flow channels.

5. The earth drilling bit of claim 2, wherein the drill face comprises ribs carrying one or more earth drilling inserts, bailing channels separating the ribs from one another, and drilling fluid flutes formed where the outer edge of the drill face meets the outer periphery of the cutting member.

6. The earth drilling bit of claim 2, wherein the shank member is provided with at least one drilling fluid delivery channel for delivering drilling fluid to the outer periphery of the cutting member.

7. The earth drilling bit of claim 6, wherein the drilling fluid delivery channel delivers drilling fluid to the segment of the drill face raised away from engagement with the hole face.

8. An earth drilling bit for use with a string of dual concentric drill pipe, comprising:

a nutating, toroidal shaped bit member having a generally annular drill face, a longitudinally extending axial passageway, and a cutting web formed in the lower end of the axial passageway, the center of the cutting web being offset with respect to the longitudinal axis of the bit, the cutting web being attached to the drill face and dividing the lower end of the axial passageway into a plurality of separate flow channels, the cutting web and the drill face having ribbed members carrying one or more earth drilling inserts, the drill face rib members being separated by radially disposed bailing channels, and the bit member having a series of drilling fluid flutes formed where the outer edge of the drill face meets the outer periphery of the bit member;

a longitudinally extending annular shank member, the inner opening in the shank member forming a cylindrical central conduit positioned over and in flow communication with the axial passageway of the bit member, the shank member having a drilling fluid delivery channel for delivering drilling fluid to the outer periphery of the bit member; and means for rotatably mounting the bit member on the lower end of the shank member, with the rotational axis of the bit member formed at a small angle with respect to the rotational axis of the shank member.

9. The earth drilling bit of claim 8, wherein the cutting web comprises three radially extending web elements and wherein no two drilling inserts on the web elements are the same distance from the longitudinal axis of the bit.

10. The earth drilling bit of claim 8, wherein the outer edge of the drill face comprises an alternating series of drill face rib members and drilling fluid flutes and wherein the outer periphery of the bit member is provided with earth drilling inserts.

11. The earth drilling bit of claim 8, wherein the inner edges of the bailing channels and the lower end of the axial passageway are partially cut away to form bailing passages.

12. The earth drilling bit of claim 8, wherein the surface of the drill face is conical.

13. The earth drilling bit of claim 8, wherein the delivery channel delivers drilling fluid to the portion of the outer periphery of the bit member opposite the portion of the bit member in drilling engagement with the bottom of the bore hole.

14. A nutating earth drilling bit, for use with a string of dual concentric drill pipe which delivers drilling fluid to the bit through the annular conduit between its inner and outer strings of pipe and which returns drilling fluid and cuttings to the surface through the inner conduit, comprising:

an annular shank member having a central longitudinal passageway in flow communication with the inner conduit of the drill pipe string;

a toroidal cutting member having a longitudinally extending central passageway in flow communication with the central passageway of the shank member, a generally annular drill face and a segmented bridge member formed in the lower end of the central passageway attached to the drill face, the drill face and the bridge member carrying a plurality of earth drilling inserts;

means for rotatably mounting the upper end of the cutting member on the lower end of the shank member with the longitudinal axis of the cutting member being angularly displaced with respect to the longitudinal axis of the shank; and a drilling fluid channel within the shank member, the upper end of the channel being positioned for receiving drilling fluid from the annular conduit of the drill pipe string, the lower end of the channel being positioned for delivering the drilling fluid to the outer periphery of the cutting member.

15. The earth drilling bit of claim 14, wherein the drilling inserts on the drill face and bridge member are carried on raised rib elements, the raised rib elements being separated from each other by bailing channels.

16. An earth drilling bit, comprising:

a nutating, toroidal shaped cutting member including a generally annular drilling face having a ribbed inner edge, the drilling face carrying a plurality of spaced apart earth drilling inserts for drilling an annular bore hole around an axially located, undrilled earth core, the cutting member having a ribbed inner periphery contiguous with the ribbed inner edge of the drilling face, the inner periphery forming a longitudinally extending axial passageway for the upward passage of cuttings, drilling fluid and the earth core, with the spaces between the ribs forming channels for the upward passage of the drilling fluid and the cuttings, the ribs on the inner periphery carrying spaced apart earth drilling inserts;

a longitudinally extending, annular shank member, the inner opening in the shank member forming a cylindrical central conduit to receive the earth core, drilling fluid and cuttings from the passageway, the conduit being positioned over and in flow communication with the axial passageway of the cutting member, the shank member having a core breaking means mounted along the central conduit to break the core into short segments which are carried to the surface by the drilling fluid and a drilling fluid channel for delivering drilling fluid to the outer periphery of the cutting member; and means for rotatably mounting the cutting member on the lower end of the shank member, with the rotational axis of the cutting member being angularly displaced with respect to the rotational axis of the shank member.

17. The earth drilling bit of claim 16, wherein the surface of the drilling face is conical.

18. The earth drilling bit of claim 16, wherein the drilling fluid channel delivers drilling fluid to the portion of the outer periphery of the cutting member opposite the portion of the cutting member in drilling engagement with the bottom of the bore hole.

* * * * *

UNITED STATES PATENT AND TRADEMARK OFFICE

CERTIFICATE OF CORRECTION

PATENT NO. : 4,168,755

DATED : September 25, 1979

INVENTOR(S) : Clyde A. Willis

It is certified that error appears in the above-identified patent and that said Letters Patent are hereby corrected as shown below:

Column 11, line 57, "is" should read -- it --.

Column 11, line 63, change "on" to --one--.

Signed and Sealed this

First Day of July 1980

[SEAL]

*Attest:*

SIDNEY A. DIAMOND

*Attesting Officer*

*Commissioner of Patents and Trademarks*